United States Patent [19]

Racine

[11] 4,294,369

[45] Oct. 13, 1981

[54] LIQUID DISPENSING RECEPTACLE

[76] Inventor: Pierre Racine, 4801, rue Rachel, Pierrefonds, P. Q., Canada, H8Y 2C6

[21] Appl. No.: 115,247

[22] Filed: Jan. 21, 1980

[30] Foreign Application Priority Data

Dec. 20, 1979 [CA] Canada ..... 342373

[51] Int. Cl.[3] ..... E03D 9/03

[52] U.S. Cl. ..... 215/311; 4/227; 222/56

[58] Field of Search ..... 215/311; 222/56, 67; 4/227, 228

[56] References Cited

U.S. PATENT DOCUMENTS 815,837 3/1906 Johnson ..... 215/311

3,908,209 9/1975 Fillmore ..... 4/227

4,066,187 1/1978 Nieman ..... 4/227 X 4,189,793 2/1980 Williamson ..... 4/227 X

*Primary Examiner*—Donald F. Norton

*Attorney, Agent, or Firm*—Cushman, Darby & Cushman

[57] ABSTRACT

The a fluid-tight receptacle comprises a container with a neck portion, a cup-shaped member tightly engaged within the neck portion, a cap threadedly engaged with the neck portion, a resilient liner inside the cap, and a float member slidably and concentrically mounted within the cup-shaped member; the float member has a cup portion so dimensioned as to lie within the cup-shaped member so that tight engagement of the cap to the neck portion forces the rim of the cup-shaped member to sink in the resilient liner of the cap; this prevents fluid leakage from the container during transport or as a result of accidental tip of the container.

5 Claims, 4 Drawing Figures

LIQUID DISPENSING RECEPTACLE

FIELD OF THE INVENTION

The present invention pertains to an improved package which is ultimately used in the automatic and periodic dispensing of a liquid into a flush tank or the like.

BACKGROUND OF THE INVENTION

Dispensers for toilet bowl cleaners deliver a metered quantity of a cleaning fluid into the flush tank of a toilet. This cleaning fluid usually consists of a chemical desinfectant and/or deodorizer which is released into the water closet each time flushing occurs. The prior art gives many examples of such dispensing packages. The following patents are illustrative: Canadian Pat. No. 921,879 issued Feb. 27, 1973, Canadian Pat. No. 975,106 issued Sept. 30, 1975, U.S. Pat. No. 3,908,209 issued Sept. 30, 1975 and U.S. Pat. No. 4,066,187 issued Jan. 3, 1978.

However, during transport or as a result of an accidental tip of the dispenser in the retail store or at home, the highly stainable solution leaks outside the container. This is due in the case of the dispensers of the above mentioned patents, for example, that the float member, which is a loosely mounted part of the dispenser package, is usually so dimensioned that its upper rim extends beyond the upper edge of the cup member or of the container, and the cap must be so shaped as to fit the contour of the upper neck portion of the container and that of the protruding float member. This results in a package with inadequate sealing of the fluid, which is usually inside the cup member even prior to first opening or use of the container.

OBJECTS AND STATEMENTS OF THE INVENTION

It is an object of this invention to provide a fluid-tight package for dispensers of the type described.

This is achieved by locating a float member inside the cup-shaped member so that the cap engages at least the cup-shaped member rather than the float member only so that tight engagement between the cap and the container can be achieved. The cap of the present invention is provided with a resilient liner so that the upper edge of the cup member can be forcibly engaged in and with the liner to provide a leak-proof engagement.

It is to be noted that the upper edge of the float member may extend at least at the level of the upper edge of the cup member, when the container is in an upstanding position, and even engage the liner. However, the float member should not extend beyond that level to prevent engagement between the cup member and the cap.

The present invention therefore relates to a fluid-tight package for ultimate use in the automatic and periodic dispensing of a liquid into a flush tank or the like, which comprises, in its broadest aspect:

(a) a container having a body with a neck portion, the neck portion having a mouth with an upper edge;

(b) a cup-shaped member tightly engaged in the neck portion, the member having a side wall with an annular rim extending at the upper edge of the neck portion of the container, the cup-shaped member including also a bottom end wall with an axial opening therethrough;

(c) a cap threadedly engaged exteriorly with the neck portion and having a flat circular inner top wall;

(d) a resilient liner tightly received in the cap on the inner top wall thereof; and (e) a float member slidably mounted relative to the cup-shaped member, the float member including a cup portion concentrically slidable within the cup-shaped member and a lower stem portion slidable through the opening of the bottom end wall; the stem portion having an enlarged end portion adapted to abut against the bottom end wall whereby movement of the float member in the cup-shaped member and of the stem portion in the opening is limited by the enlarged lower portion of the stem and the bottom of the cup portion, the cup portion having an upper edge disposed at a level which is at or below the level of the rim of the cup member whereby tight engagement of the cap on the container results in sunken engagement of the rim in the resilient liner to thereby prevent fluid leakage from the cup member.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from the detailed description.

DESCRIPTION OF A PREFERRED EMBODIMENT

Figure 1:
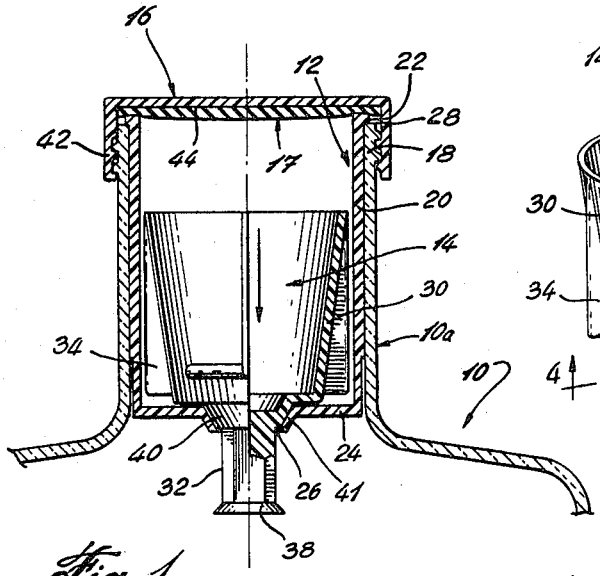
FIG. 1 is a cross-sectional view of the top portion of a fluid-tight package made in accordance with the present invention.
Figure 3:
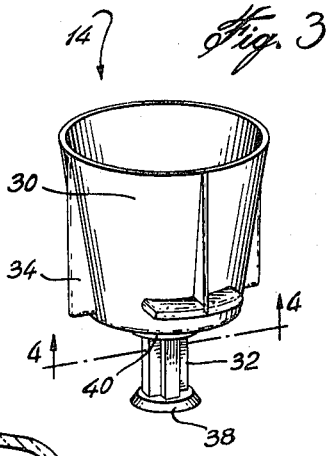
FIG. 3 is a perspective view of the float member used in the package of the present invention.

Referring to the drawings, the five principal elements of the package of the present invention are shown as consisting of a container 10, a cup-shaped member 12, a float member 14, a cap 16 and a liner 17.

The container 10 may be made of glass, plastic, metal or a composite material and includes a neck portion 10*a* with a threaded outer portion 18.

The cup-shaped member 12 has an annular side wall 20 with an outwardly flanged upper edge 22, and a bottom end wall 24 with an axial circular opening 26. The cup-shaped member is preferably made of a plastic material and is tight fitted inside the neck portion 10*a* of the container, the upper edge 22 resting over part of the upper edge 28 of the mouth of the neck portion 10*a*.

Figure 2:
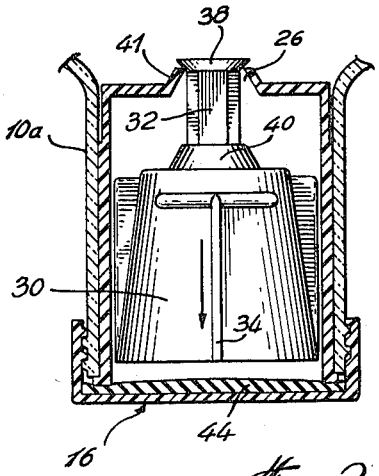
FIG. 2 is a similar cross-sectional view with a package in the inverted position.
Figure 4:
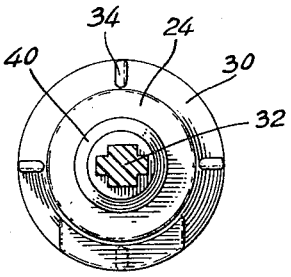
FIG. 4 is a cross-sectional bottom view taken along lines 4—4 of FIG. 3.

The float member 14 comprises a cup portion 30 and a stem portion 32. When assembled to the package, as illustrated in FIG. 1, the stem portion 32 extends through opening 26 below the bottom end wall 24 of the cup-shaped member 12. The cup portion 30 has a tapering side wall and includes a pair of diametrically opposite triangular shaped guiding ribs 34 to maintain the float member in vertical relationship relative to the cup-shaped member 12. The stem portion 32 has a cruciform shape with an enlarged lower skirt portion 38. The bottom wall of the cup portion 30 has a frusto-conical portion 40 which is adapted to fit in a complementary shaped portion 41 in the bottom wall 24 of the cup-shaped member 12. Therefore, in the upstanding position of the container as shown in FIG. 1, section 40 fits in projection 41 and closes the opening 26 in the bottom end wall 24. In the inverted position shown in FIG. 2, opening 26 is blocked by skirt 38. In one preferred form of the invention, the lower portion 38 is thin and flexible so that the float member 14 can be pressed fitted into assembly with the cup-shaped member 12 by forcing the lower portion 38 through the circular opening 26 in the bottom wall 24. However, the skirt 38 is sufficiently rigid to maintain the float member in the suspended position of FIG. 2.

The cap member 16 has an annular side wall 42 which threadedly engages the threaded portion 18 of the neck portion 10*a*. Liner 18 covers the entire circular inner top wall 44 of the cap. This liner is resilient. A foam material has been found adequate for the purpose of allowing rim 22 to sink into it as a result of forcing cap 16 on the container.

The embodiment represented in the drawings illustrates one important feature of the present invention, that is the upper edge of the cup portion 30 of the float member is below the plane that includes rim 22 of cup member 12. This ensures that, when the cap is tightly fitted to the container, rim 22 sinks into the resilient liner 18 to thereby prevent fluid leakage outside the container. Although not represented in the drawings, cup portion 30 may have its upper edge at the same level or plane of rim 22, in which case this upper edge would also sink into the resilient liner. However, the upper edge of the cup portion 30 must not prevent sunken engagement of rim 22 in the liner 18.

One suitable material found for the float member and the cup is a polyethylene, such as nylon (trademark).

In operation, the float member 14 reciprocates between an upper sealing position (see FIG. 2) and a lower sealing position (see FIG. 1) as a function of the water level in the flush tank. Dispensing of the liquid inside the container occurs when protrusion 40 on the bottom wall of the float member leaves protrusion 41 until skirt 38 blocks opening 26. However, this dispensing is minor since the downward movement of water as a result of the flush is quick. On the other hand, when the flush tank is filled with water, the latter causes the float member to raise slowly thereby letting a greater amount of cleaning fluid to pass between the stem portion and the opening 26. Once the tank is filled or when the water level has reached a given point, protrusion 40 reaches recess 41 and completely blocks opening 26.

The embodiments of the invention in which an exclusive property or privilege is claimed are defined as follows:

1. A fluid-tight receptacle for ultimate use in the automatic and periodic dispensing of a liquid into a flush tank or the like, comprising:

(a) a container having a body with a neck portion, said neck portion having a mouth with an upper edge;

(b) a cup-shaped member tightly engaged in said neck portion, said member having a side wall with an annular rim extending at said upper edge of said neck portion of said container, said cup-shaped member including a bottom end wall with an axial opening therethrough;

(c) a cap threadedly engaged exteriorly with said neck portion, said cap having a flat circular inner top wall;

(d) a resilient liner tightly received in said cap on said top wall thereof; and (e) a float member slidably mounted relative to said cup member, said float member including a cup portion concentrically mounted within said cup-shaped member and a lower stem portion slidable through said opening of said bottom end wall; said stem portion including an enlarged end portion adapted to abut against said bottom end wall whereby movement of said float member in said cup-shaped member and of the stem portion in the opening is limited by said enlarged portion and said cup portion; said cup portion having an upper edge extending at a level which is at or below the level of said rim of said cup-shaped member, whereby tight engagement of said cap with said container results in sunken engagement of said rim in said resilient liner to thereby prevent fluid leakage from said cup-shaped member.

2. A fluid-tight receptacle as defined in claim 1, wherein said liner is made of foam material.

3. A fluid-tight receptacle as defined in claim 1 or 2, wherein said cup-shaped member is tight fitted in said neck portion.

4. A fluid-tight receptacle as defined in claim 1 or 2, wherein said enlarged end portion of said stem portion is made of flexible material and is slightly larger than said opening whereby said enlarged end portion may be forced through said opening of said cup-shaped member for assembly or disassembly of said float member to or from said cup-shaped member.

5. A fluid-tight receptacle as defined in claim 1 or 2, wherein said cup portion has a tapering outer wall and guiding ribs thereon for maintaining axial movement of said cup portion inside said cup-shaped member.

* * * * *